US011378265B2

(12) United States Patent
Wang

(10) Patent No.: US 11,378,265 B2
(45) Date of Patent: Jul. 5, 2022

(54) SPOT LAMP HOLDER AND SPOT LAMP

(71) Applicant: OPPLE LIGHTING CO., LTD., Shanghai (CN)

(72) Inventor: Quanbiao Wang, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/138,633

(22) Filed: Dec. 30, 2020

(65) Prior Publication Data

US 2021/0116111 A1 Apr. 22, 2021

Related U.S. Application Data

(63) Continuation of application No. PCT/CN2019/107115, filed on Sep. 20, 2019.

(30) Foreign Application Priority Data

Sep. 21, 2018 (CN) ..... 201821555190.3

(51) Int. Cl.
*F21V 21/30* (2006.01)
*F21V 17/12* (2006.01)
*F21V 17/16* (2006.01)

(52) U.S. Cl.
CPC ..... *F21V 21/30* (2013.01); *F21V 17/12* (2013.01); *F21V 17/16* (2013.01)

(58) Field of Classification Search
CPC ..... F21V 21/30; F21V 19/004; F21V 21/088; F21V 21/044
See application file for complete search history.

(56) References Cited

U.S. PATENT DOCUMENTS 6,554,457 B1 * 4/2003 Platt ..... F21V 19/04 362/269
2014/0254177 A1 * 9/2014 Danesh ..... F21S 8/026 362/363
2021/0116111 A1 * 4/2021 Wang ..... F21S 8/026

FOREIGN PATENT DOCUMENTS

| | | | |
|---|---|---|---|
| CN | 203615193 | U | 5/2014 |
| CN | 106287442 | A | 1/2017 |
| CN | 106704921 | A | 5/2017 |
| CN | 206875265 | U | 1/2018 |
| CN | 208652337 | U | 3/2019 |
| EP | 2706284 | A1 | 3/2014 |

OTHER PUBLICATIONS

International Search Report of PCT Application No. PCT/CN2019/107115 dated Dec. 19, 2019 with English translation, (4p).

* cited by examiner

*Primary Examiner* — Leah Simone Macchiarolo
(74) *Attorney, Agent, or Firm* — Arch & Lake LLP

(57) ABSTRACT

A spot lamp holder and spot lamp are provided. The spot lamp holder may include a first housing and a second housing. The second housing may include a mounting cavity. A mounting end of the second housing may be an open end and coupled with the mounting cavity. A first limiting portion and a second limiting portion spaced apart from each other may be disposed on an inner wall of the mounting cavity. A mounting groove may be disposed between the first limiting portion and the second limiting portion. The first housing may include a clamping portion. The clamping portion may be fitted with the mounting groove.

16 Claims, 8 Drawing Sheets

II

SPOT LAMP HOLDER AND SPOT LAMP

CROSS-REFERENCE TO RELATED APPLICATIONS

This application is a continuation of PCT patent application No. PCT/CN2019/107115 filed on Sep. 20, 2019, which claims priority to Chinese Patent Application No. 201821555190.3, filed on Sep. 21, 2018, the entire contents of all of which are hereby incorporated by reference herein for all purposes.

TECHNICAL FIELD

The present disclosure relates to the technical field of lighting, and more particularly, to a spot lamp holder and a spot lamp.

BACKGROUND

Most of existing spot lamp holders are assembled from three and more components, and numerous components lead to cumbersome assembling and disassembling. Different components of a spot lamp holder are generally connected by screws, resulting in not only time-consuming assembling but also time-consuming disassembling. Different components of an existing spot lamp holder may also be connected in other ways, but these ways still have inconvenient assembling and disassembling.

In addition, after an existing spot lamp holder is assembled, different components are prone to separation no matter in drop test, in transportation, or when acted upon by a force. That is, the connection between different components exhibits low reliability after the existing spot lamp holder is assembled.

SUMMARY

The present disclosure provides a spot lamp holder and a spot lamp.

According to a first aspect, the present disclosure provides a spot lamp holder. The spot lamp holder may include a first housing and a second housing. The second housing may include a mounting cavity. A mounting end of the second housing may be an open end and coupled with the mounting cavity. A first limiting portion and a second limiting portion spaced apart from each other may be disposed on an inner wall of the mounting cavity. A mounting groove may be disposed between the first limiting portion and the second limiting portion. The first housing may include a clamping portion. The clamping portion may be fitted with the mounting groove.

According to a second aspect, the present disclosure provides a spot lamp. The spot lamp may include a first housing and second housing. The second housing may include a mounting cavity. A mounting end of the second housing may be an open end and coupled with the mounting cavity. A first limiting portion and a second limiting portion may be spaced apart from each other are disposed on an inner wall of the mounting cavity. A mounting groove may be disposed between the first limiting portion and the second limiting portion. The first housing may include a clamping portion. The clamping portion may be fitted with the mounting groove. A lamp assembly may be mounted on the spot lamp holder. The lamp assembly may include a lamp.

It is to be understood that both the foregoing general description and the following detailed description are exemplary and explanatory only and are not restrictive of the present disclosure.

BRIEF DESCRIPTION OF THE DRAWINGS

The accompanying drawings, which are incorporated in and constitute a part of this specification, illustrate examples consistent with the present disclosure and, together with the description, serve to explain the principles of the disclosure.

DETAILED DESCRIPTION

Reference will now be made in detail to example embodiments, examples of which are illustrated in the accompanying drawings. The following description refers to the accompanying drawings in which the same numbers in different drawings represent the same or similar elements unless otherwise represented. The implementations set forth in the following description of example embodiments do not represent all implementations consistent with the disclosure. Instead, they are merely examples of apparatuses and methods consistent with aspects related to the disclosure as recited in the appended claims.

The terminology used in the present disclosure is for the purpose of describing particular embodiments only and is not intended to limit the present disclosure. As used in the present disclosure and the appended claims, the singular forms "a," "an," and "the" are intended to include the plural forms as well, unless the context clearly indicates otherwise. It shall also be understood that the term "and/or" used herein is intended to signify and include any or all possible combinations of one or more of the associated listed items.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to a judgment" depending on the context.

Figure 1:
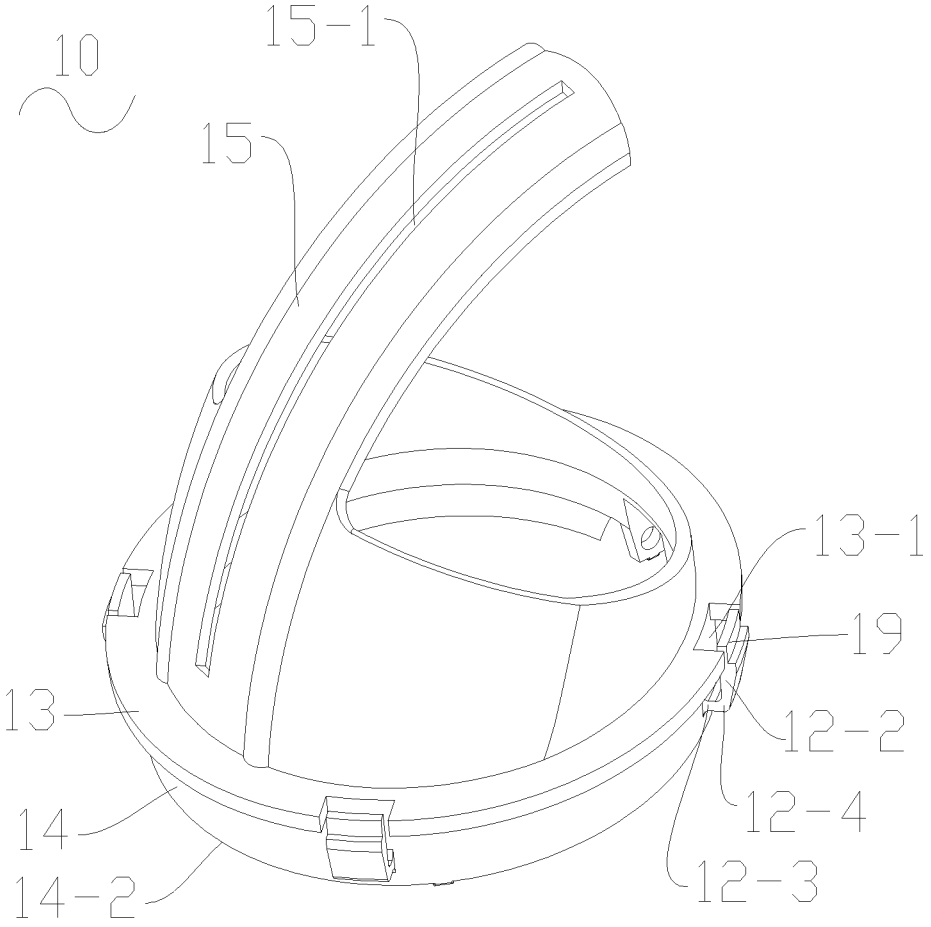
FIG. 1 is a structural schematic diagram of a first housing according to one or more embodiments of the present disclosure.

FIG. 1 is a structural schematic diagram of a first housing according to one or more embodiments of the present disclosure. A spot lamp holder in the present embodiment includes a first housing 10 and a second housing 20. The second housing 20 has a mounting cavity 21. A mounting end 211 of the second housing 20 is an open end and communicated with the mounting cavity 21. A first limiting portion 22 and a second limiting portion 26 spaced apart from each other are disposed on the inner wall of the mounting cavity 21. A mounting groove is formed between the first limiting portion 22 and the second limiting portion 26. The first housing 10 includes a clamping portion 18, the clamping portion 18 is in clamping fit with the mounting groove. The spot lamp holder in the present embodiment includes two components, namely the first housing 10 and the second housing 20. Compared with an existing spot lamp holder including three and more components, the components of the spot lamp holder of the present disclosure are relatively less, which allows for convenient and rapid assembly. The first housing 10 and the second housing 20 in the present embodiment are assembled by clamping the clamping portion 18 in the mounting groove. Compared with the assembling of various components of an existing spot lamp holder by tightening screws, the first housing 10 and the second housing 20 in the present embodiment can be assembled conveniently and rapidly.

In one or more embodiments, the mounting cavity 21 is opened at top and bottom. Each of the first limiting portion 22 and the second limiting portion 26 has a ring-like structure, and an inner diameter of the second limiting portion 26 is smaller than that of the first limiting portion 22. Instead of the ring-like structure, each of the first limiting portion 22 and the second limiting portion 26 in the present embodiment may also have a structure formed by a plurality of discontinuous circular arcs arranged in the circumferential direction.

Figure 2:
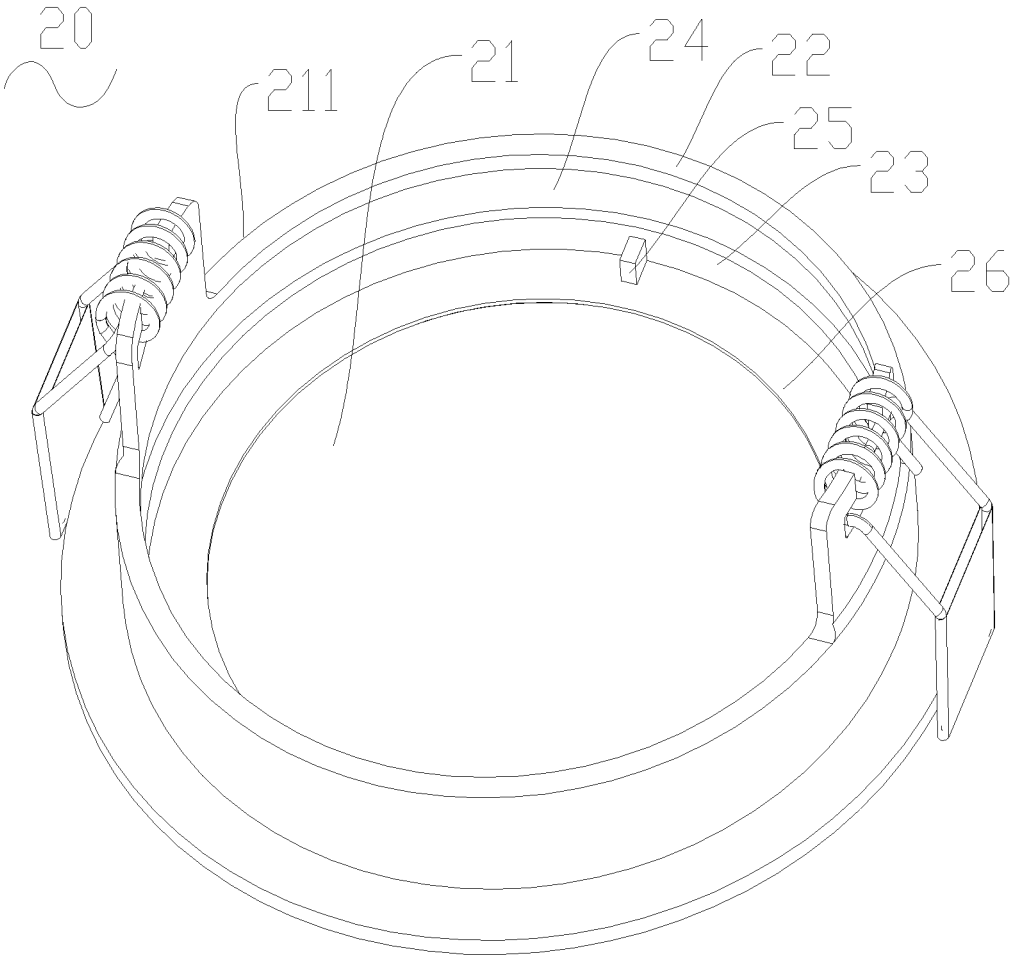
FIG. 2 is a structural schematic diagram of a second housing according to one or more embodiments of the present disclosure.

FIG. 2 is a structural schematic diagram of a second housing according to one or more embodiments of the present disclosure. As shown in FIG. 2, the distance between the second limiting portion 26 and the mounting end 211 of the second housing 20 is greater than the distance between the first limiting portion 22 and the mounting end 211 of the second housing 20. That is, the first limiting portion 22 is closer to the mounting end 211 of the second housing 20 than the second limiting portion 26. The first limiting portion 22 is disposed on the mounting end 211 of the second housing 20.

Figure 3:
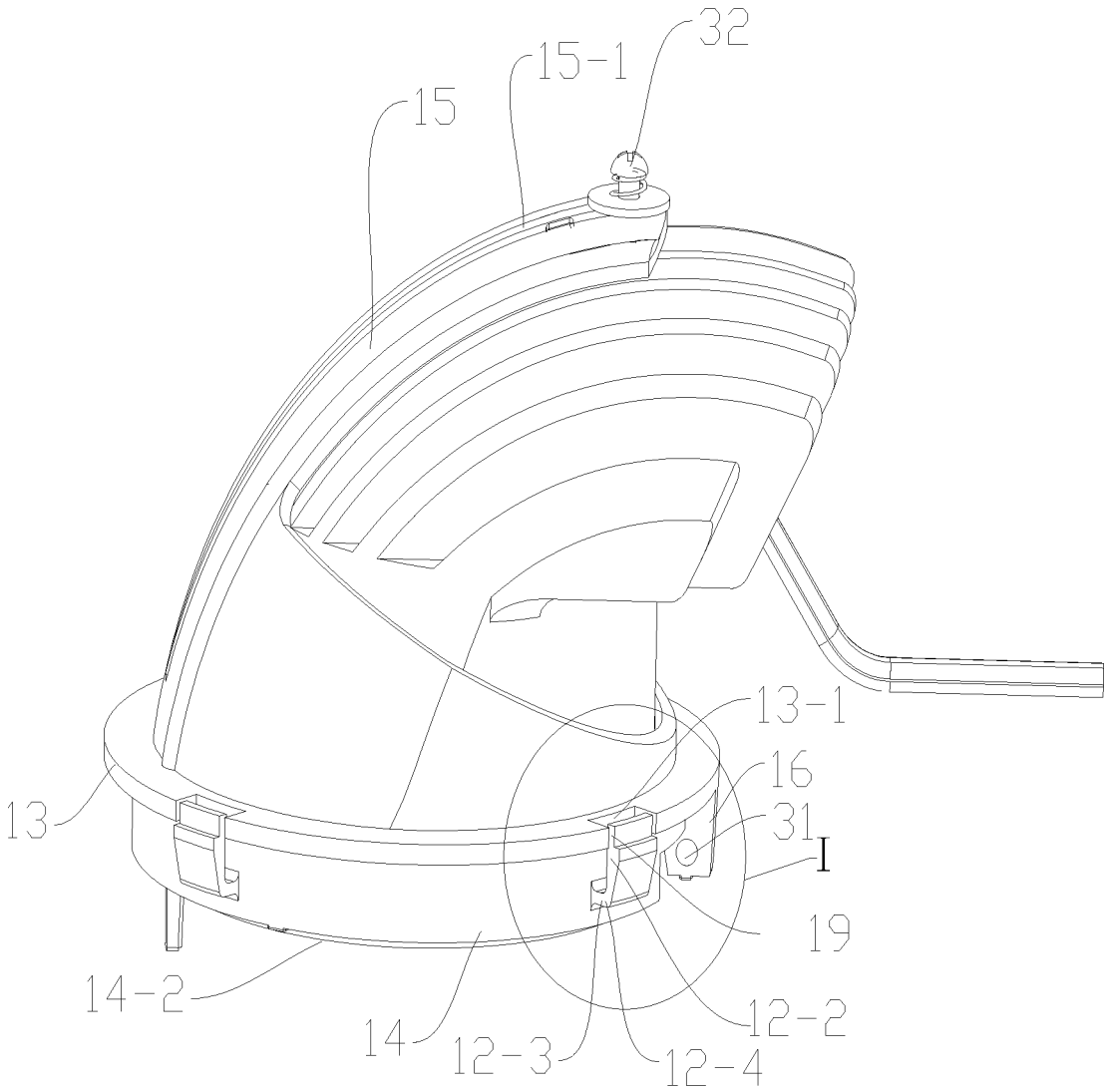
FIG. 3 is a structural schematic diagram of a first housing and a lamp assembly after being combined according to one or more embodiments of the present disclosure.
Figure 4:
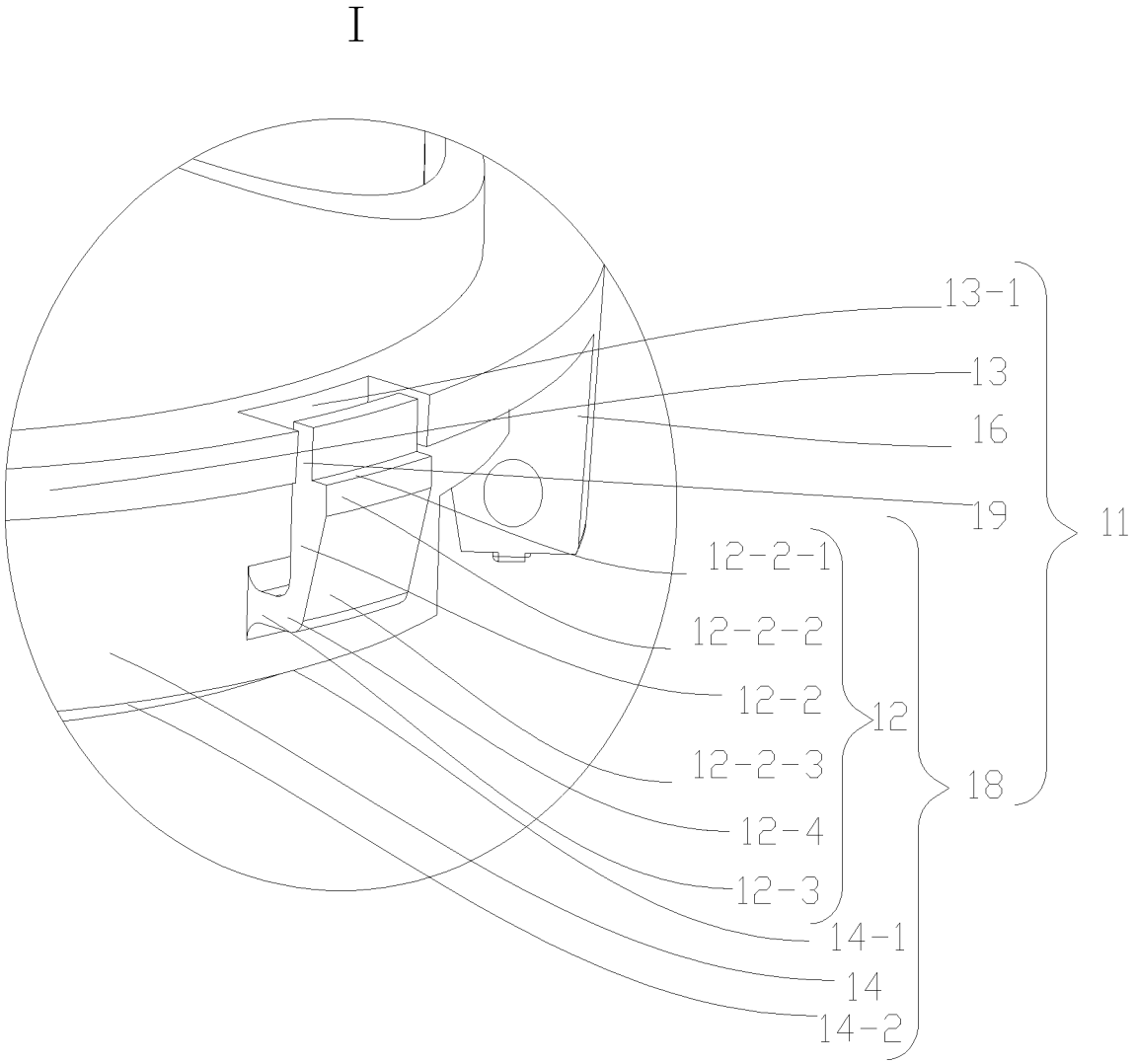
FIG. 4 is a partial enlarged view of area I in FIG. 3 according to one or more embodiments of the present disclosure.

As shown in FIG. 2 to FIG. 4, the clamping portion 18 includes a movable body 12, and the movable body 12 is in movable limiting fit with the first limiting portion 22. The clamping portion 18 of the first housing 10 may be pressed toward the second housing 20 into the mounting cavity 21 until the movable body 12 enters the mounting groove and expands outwards to be restrained by the first limiting portion 22. In this case, two ends of the clamping portion 18 of the first housing 10 are restrained by the first limiting portion 22 and the second limiting portion 26, respectively. With the clamping fit between the clamping portion 18 and the mounting groove, the first housing 10 and the second housing 20 can be assembled together.

In one or more embodiments, the movable body 12 is made of an elastic material and 3-5 movable bodies 12 are used. A plurality of movable bodies 12 may be arranged at intervals in the circumferential direction. During the process of pressing the clamping portion 18 of the first housing 10 toward the second housing 20 into the mounting groove, the movable body 12 is first pressed inwards by the first limiting portion 22, and after entering the mounting groove, the movable body 12 expands outwards to be restrained by the first limiting portion 22. Alternatively, the movable body 12 in the present embodiment may not be made of an elastic material. Instead, the movable body 12 may be movably mounted on the clamping portion 18 through an intermediate elastic component. The movable body 12 can be moved through the intermediate elastic component.

In one or more embodiments, as shown in FIG. 1 and FIG. 4, the first housing 10 includes a first connecting portion 11. The first connecting portion 11 includes a first ring 13, a clamping portion 18, a stop block 16, and an operating portion 19. The clamping portion 18 includes a movable body 12 and a second ring 14. The second ring 14 is closer to the connecting end 14-2 of the first housing 10 than the first ring 13. The movable body 12 is mounted on the second ring 14.

Figure 7:
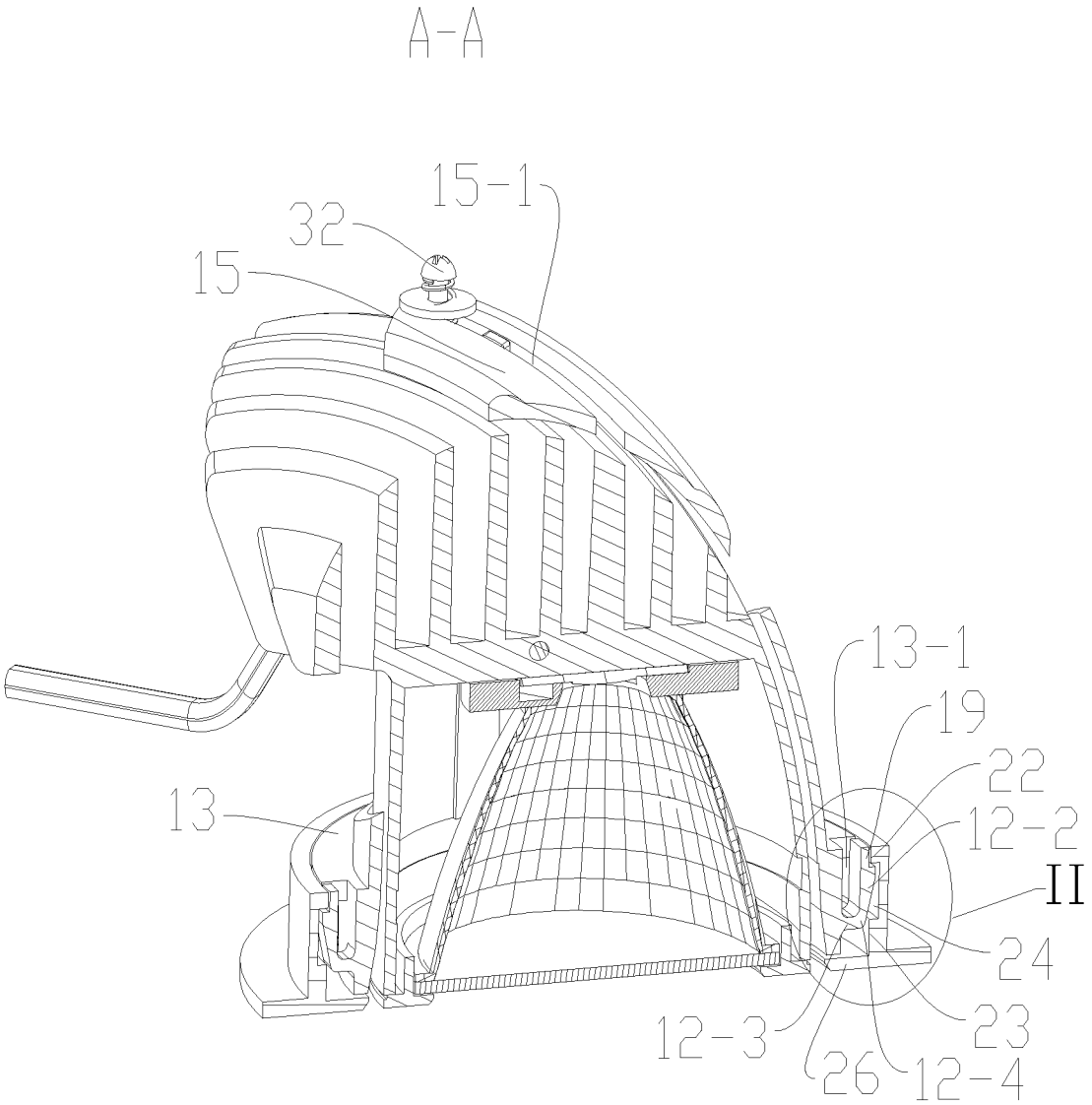
FIG. 7 is a sectional view of the spot lamp along a A-A direction in FIG. 6 according to one or more embodiments of the present disclosure.
Figure 8:
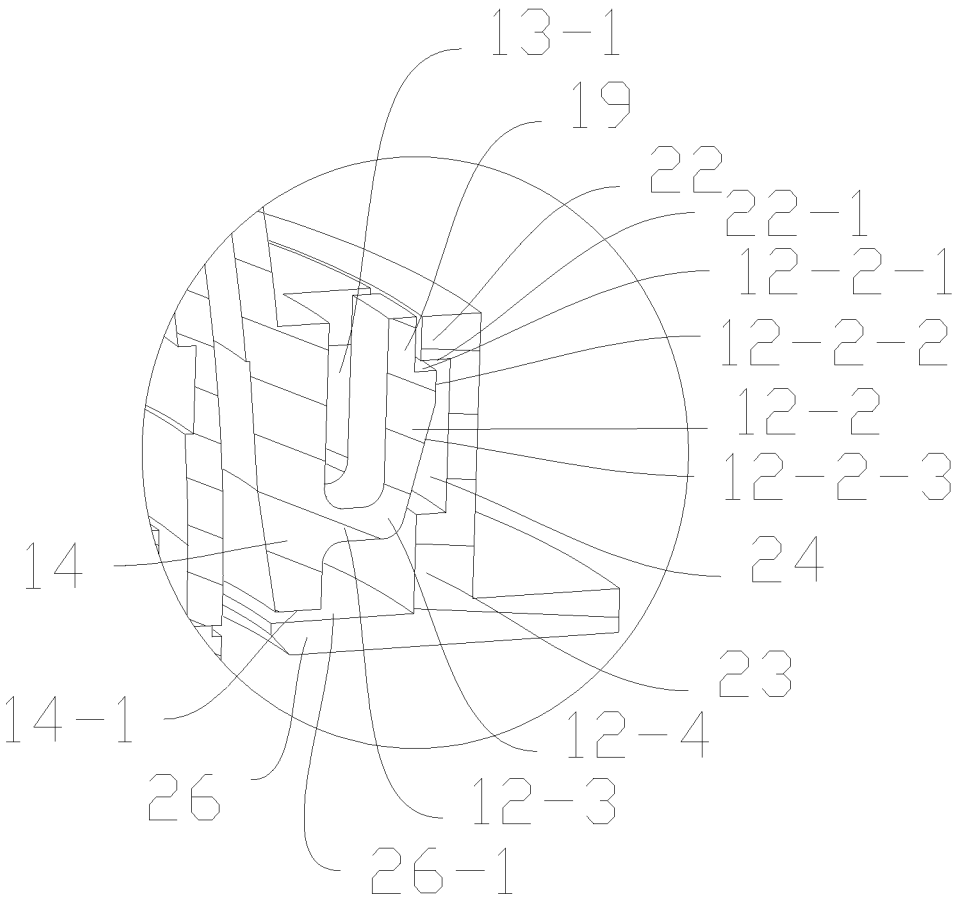
FIG. 8 is a partial enlarged view of area II in FIG. 7 according to one or more embodiments of the present disclosure.

As shown in FIG. 7 and FIG. 8, the surface, oriented toward the second limiting portion 26, of the first limiting portion 22 is a first limiting surface 22-1, while the surface, oriented toward the first limiting portion 22, of the second limiting portion 26 is a second limiting surface 26-1. FIG. 4 is a partial enlarged view of area I in FIG. 3 according to one or more embodiments of the present disclosure. The movable body 12 has a first surface 12-2-1 in movable limiting fit with the first limiting surface 22-1, while the second ring 14 has a second surface 14-1 in limiting fit with the second limiting surface 26-1.

The first ring 13 has an inwardly depressed anti-collision groove 13-1 corresponding to the movable body 12, and a moving gap is formed between the movable body 12 and the anti-collision groove 13-1. To facilitate the inward moving of the movable body 12 and to facilitate the assembling and disassembling of the first housing 10 and the second housing 20, the first ring 13 may have a plurality of anti-collision grooves 13-1 disposed uniformly in the circumferential direction. Each anti-collision groove 13-1 is depressed inwardly and disposed corresponding to the movable body 12, and a moving gap is formed between the movable body 12 and the anti-collision groove 13-1, allowing the movable body 12 to move inwards. In one or more embodiments, the operating portion 19 is connected to the movable body 12; or, the operating portion 19 is integrally formed with the movable body 12. The movable body 12 includes a main portion 12-2, a mounting portion 12-3 and a circular arc portion 12-4. The surface, oriented toward the first limiting surface 22-1, of the main portion 12-2 is a first surface 12-2-1. The operating portion 19 is disposed directly facing the anti-collision groove 13-1.

FIG. 3 is a structural schematic diagram of a first housing and a lamp assembly after being combined according to one or more embodiments of the present disclosure. As shown in FIG. 3, the operating portion 19 is located in the anti-collision groove 13-1, and an outer lateral surface of the operating portion 19 is located along the same circumferential surface with the outer surface of the first ring 13. The operating portion 19 may also be disposed directly facing the anti-collision groove 13-1, but located outside the anti-collision groove 13-1.

A moving gap is formed between the operating portion 19 and the anti-collision groove 13-1. When disassembling the first housing 10 and the second housing 20, the operating portion 19 is pushed inwards, causing the main portion 12-2 to move inwards to be disengaged from the first limiting surface 22-1. After all the main portions 12-2 are disengaged from the first limiting surface 22-1, the first housing 10 can be dismounted from the second housing 20 conveniently.

As shown in FIG. 1, the second ring 14 has a smaller diameter than the first ring 13. The second ring 14 has a greater height than the first ring 13.

During the moving of the movable body 12, breakage may easily occur between the mounting portion 12-3 and the main portion 12-2. Therefore, the circular arc portion 12-4 is used for transition between the mounting portion 12-3 and the main portion 12-2 so as to prolong the service life of the movable body 12.

In one or more embodiments illustrated in FIG. 4, the outer lateral surface of the main portion 12-2 includes a first outer lateral surface 12-2-2 close to the first limiting portion 22 and a second outer lateral surface 12-2-3 far away from the first limiting portion 22. The second outer lateral surface 12-2-3 is an inclined guide surface that serves for guiding. The second outer lateral surface 12-2-3 has a proximal end that is close to the first limiting portion 22 and a distal end that is far away from the first limiting portion 22. The second outer lateral surface 12-2-3 is slanted from the distal end to the proximal end toward the inner wall of the mounting cavity 21. With the second outer lateral surface 12-2-3 for guiding, the clamping portion 18 can be pressed into the mounting groove and moved out of the mounting groove conveniently. The first outer lateral surface 12-2-2 is disposed perpendicular to the first surface 12-2-1.

As shown in FIG. 2, a convex ring 23 is disposed between the first limiting portion 22 and the second limiting portion 26 on the inner wall of the mounting cavity 21. A clamping groove 24 is formed between the convex ring 23 and the first limiting portion 22 and matched with the main portion 12-2.

The clamping portion 18 can be rotated in the mounting groove. That is, the first housing 10 and the second housing 20 can be rotated relative to each other. A limiting block 25 is mounted on the second housing 20 so as to limit the angle of rotation of the first housing 10 and the second housing 20 relative to each other. The limiting block 25 is in limiting fit with the first housing 10 in the direction of rotation of the first housing 10. In one or more embodiments, the limiting block 25 is mounted on the inner wall of the convex ring 23; or, the limiting block 25 is mounted on the second limiting surface 26-1 of the second limiting portion 26; or, two surfaces of the limiting block 25 are mounted on the inner wall of the convex ring 23 and the second limiting surface 26-1 of the second limiting portion 26, respectively. Correspondingly, a stop block 16 matched with the limiting block 25 is disposed on the first housing 10. In one or more embodiments, the stop block 16 is disposed on the clamping portion 18 and located closer to the inner wall of the convex ring 23 than the outer circumferential surface of the second ring 14.

In one or more embodiments, the stop block 16 has a shaft hole 31 for mounting a lamp rotating shaft. The stop block 16 serves not only to mount a lamp rotating shaft but also to limit unrestricted 360-degree rotation of the first housing 10 and the second housing 20 relative to each other by being restrained by the limiting block 25. In one or more embodiments, the limiting structure between the limiting block 25 and the stop block 16 allows the first housing 10 and the second housing 20 to rotate about 355 degrees relative to each other.

In one or more embodiments, the first housing 10 includes an arc-shaped mounting block 15, and the arc-shaped mounting block 15 has a sliding groove 15-1. The sliding groove 15-1 is used for mounting and adjusting a sliding screw 32 therein.

The specific assembling process is provided as follows: the clamping portion 18 of the first housing 10 is pressed toward the second housing 20 into the mounting groove, during which the movable body 12 is pressed inwards by the inner wall of the first limiting portion 22. With the anti-collision groove 13-1, the movable body 12 can be moved inwards. With the second outer lateral surface 12-2-3, the movable body 12 is allowed to enter the mounting groove more smoothly. After entering the mounting groove, the movable body 12 expands outwards, i.e., toward the inner wall of the mounting cavity 21. With the limiting fit between the first surface 12-2-1 of the main portion 12-2 of the movable body 12 and the first limiting surface 22-1 and the limiting fit between the second surface 14-1 of the second ring 14 and the second limiting surface 26-1, the first housing 10 and the second housing 20 can be assembled together conveniently and rapidly. After the assembling is completed, the outer surface of the operating portion 19 comes in contact with the inner wall of the first limiting portion 22.

The specific disassembling process is provided as follows: the operating portion 19 is pushed inwards to move inwards along the anti-collision groove 13-1, causing the first surface 12-2-1 of the main portion 12-2 to be disengaged from the first limiting surface 22-1. After the first surfaces 12-2-1 of all the main portions 12-2 are disengaged from the first limiting surface 22-1 by the same way, the first housing 10 can be dismounted from the second housing 20 conveniently and rapidly.

After the spot lamp holder in the present embodiment is assembled, the first housing 10 and the second housing 20 are not prone to separation no matter in drop test, in transportation, or when acted upon by a force. That is, the connection between the first housing 10 and the second housing 20 exhibits good reliability after the spot lamp holder in the present embodiment is assembled.

A spot lamp in the present embodiment includes the spot lamp holder as described above. A lamp assembly is mounted on the spot lamp holder. The spot lamp holder of the spot lamp in the present embodiment includes two components, namely the first housing 10 and the second housing 20. Compared with an existing spot lamp holder including three and more components, the components of the spot lamp holder of the present disclosure is relatively less, which allows for convenient and rapid assembly. The first housing 10 and the second housing 20 in the present embodiment are assembled by clamping the clamping portion 18 in the mounting groove. Compared with the assembling of various components of an existing spot lamp holder by tightening screws, the first housing 10 and the second housing 20 in the present embodiment can be assembled conveniently and rapidly. Convenient and rapid assembling of the spot lamp holder leads to convenient and rapid assembling of the spot lamp in the present embodiment.

After the spot lamp holder of the spot lamp in the present embodiment is assembled, the first housing 10 and the second housing 20 are not prone to separation no matter in drop test, in transportation, or when acted upon by a force. That is, the connection between the first housing 10 and the second housing 20 of the spot lamp in the present embodiment exhibits good reliability.

Figure 5:
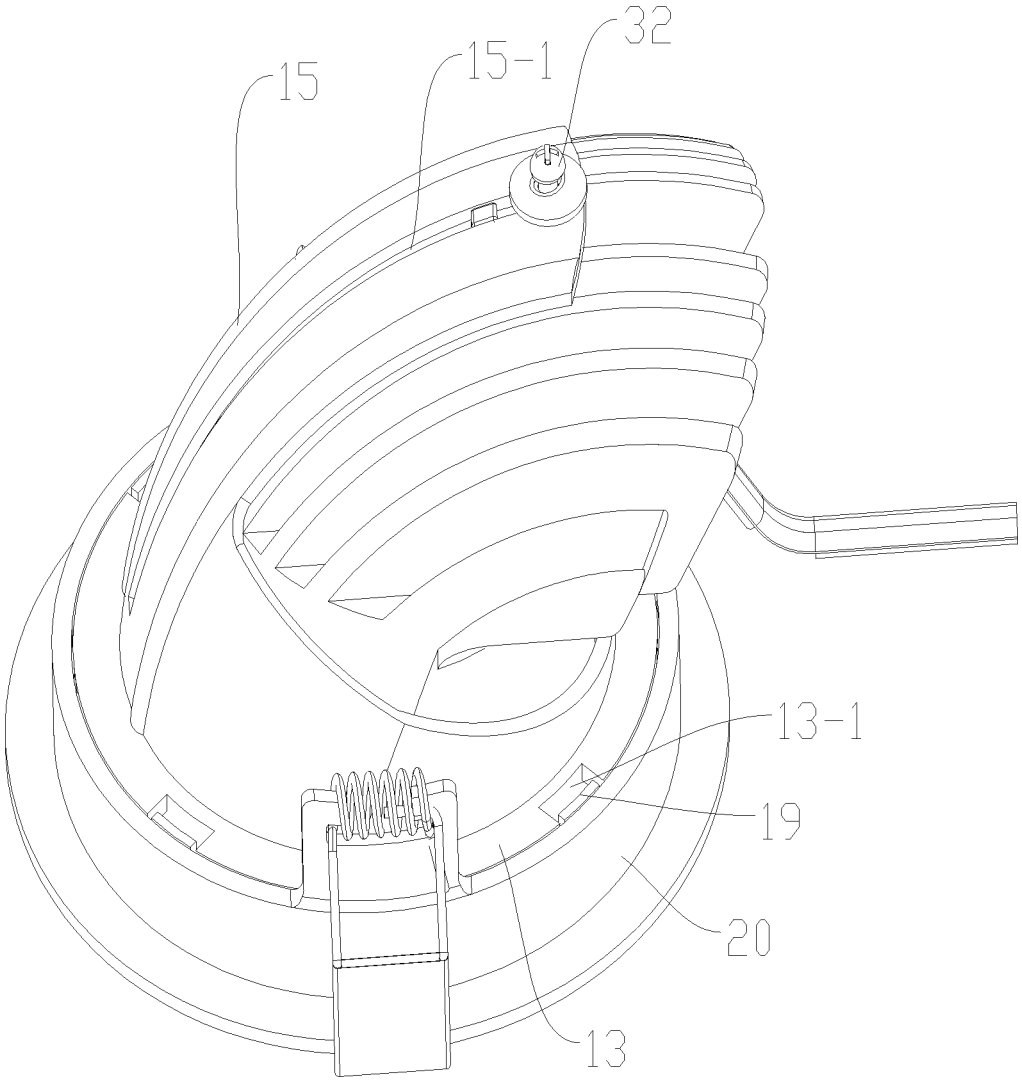
FIG. 5 is a schematic diagram of an overall structure of a spot lamp according to one or more embodiments of the present disclosure.
Figure 6:
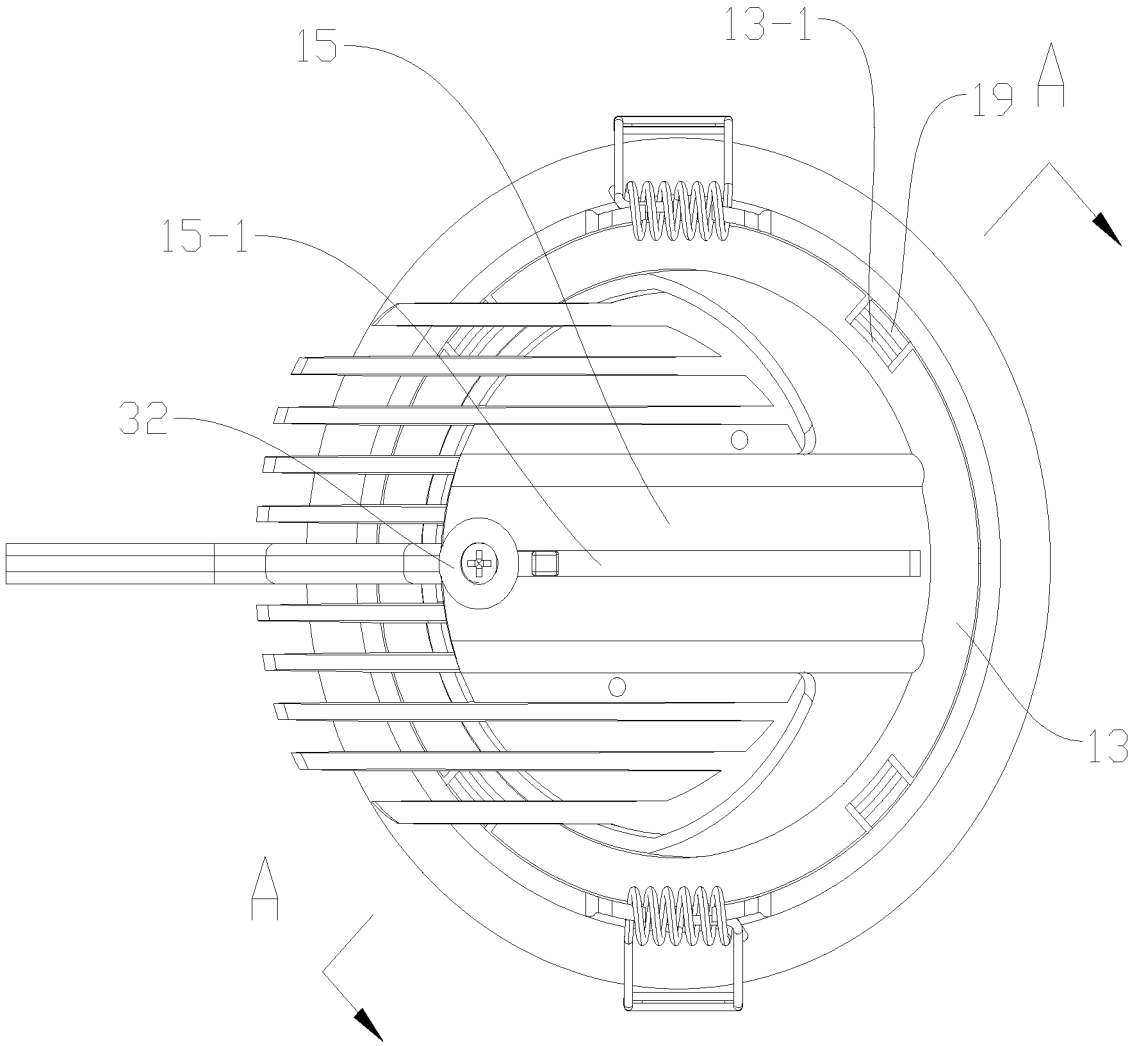
FIG. 6 is a top view of a spot lamp according to one or more embodiments of the present disclosure.

FIG. 5 is a schematic diagram of an overall structure of a spot lamp according to one or more embodiments of the present disclosure. FIG. 6 is a top view of a spot lamp according to one or more embodiments of the present disclosure.

As shown in FIG. 5 and FIG. 6, the first housing 10 includes an arc-shaped mounting block 15, and the arc-shaped mounting block 15 has a sliding groove 15-1. A sliding screw 32 is disposed in the sliding groove 15-1 and connected to the lamp assembly. A lamp is connected to the shaft hole 31 of the first housing 10 through a lamp rotating shaft. The position of the sliding screw 32 in the sliding groove 15-1 is adjusted, thereby adjusting an illuminating angle of the spot lamp. During this process, the lamp would rotate around the lamp rotating shaft. When the illuminating angle is adjusted to be an appropriate one, the sliding screw 32 is locked and thereby fixed in the sliding groove 15-1.

In one or more embodiments, a spot lamp holder has a distance between the second limiting portion and the mounting end of the second housing is greater than a distance between the first limiting portion and the mounting end of the second housing; the clamping portion includes a movable body, the movable body is in movable limiting fit with the first limiting portion.

In one or more embodiments, a spot lamp holder has a movable body made of an elastic material.

In one or more embodiments, a spot lamp holder has a movable body that includes a main portion; a convex ring is disposed between the first limiting portion and the second limiting portion on the inner wall of the mounting cavity; and a clamping groove is disposed between the convex ring and the first limiting portion and matched with the main portion.

In one or more embodiments, a spot lamp holder has a first housing that includes an inwardly depressed anti-collision groove disposed corresponding to the movable body.

In one or more embodiments, a spot lamp holder has a spot lamp holder that further includes an operating portion connected to the movable body, and the operating portion is disposed directly facing the anti-collision groove.

In one or more embodiments, a spot lamp holder has an outer lateral surface of the movable body that includes an inclined guide surface; the inclined guide surface includes a proximal end that is close to the first limiting portion and a distal end that is far away from the first limiting portion; and the inclined guide surface is slanted from the distal end to the proximal end toward the inner wall of the mounting cavity.

In one or more embodiments, a spot lamp holder has a clamping portion that includes a movable body and a second ring; and the movable body is mounted on the second ring.

In one or more embodiments, a spot lamp holder has a first housing that includes a first connecting portion; the first connecting portion includes a clamping portion and a first ring; a distance between the first ring and a connecting end of the first connecting portion is greater than a distance between the second ring and the connecting end of the first connecting portion; and the first ring includes an inwardly depressed anti-collision groove disposed corresponding to the movable body.

In one or more embodiments, a spot lamp holder has a second housing that includes a limiting block, the first housing includes a stop block, and the stop block is in limiting fit with the limiting block in a direction of rotation of the first housing.

In one or more embodiments, a spot lamp holder has a limiting block that is disposed on the inner wall of the mounting cavity, and the stop block is disposed on the clamping portion.

In one or more embodiments, a spot lamp holder has a stop block that includes a shaft hole.

In one or more embodiments, a spot lamp holder has a first housing that includes an arc-shaped mounting block; and a sliding groove is disposed on the arc-shaped mounting block.

A spot lamp, including the abovementioned spot lamp holder, a lamp assembly is mounted on the spot lamp holder; and the lamp assembly includes a lamp.

In one or more embodiments, a spot lamp holder has a first housing that is provided with a sliding groove in which a sliding screw is disposed; and the sliding screw is in sliding fit with the sliding groove, and the sliding screw is connected to the lamp assembly.

In one or more embodiments, a spot lamp holder has a second housing that includes a limiting block, the first housing includes a stop block; the stop block is in limiting fit with the limiting block in a direction of rotation of the first housing; the stop block has a shaft hole; a lamp rotating shaft is mounted in the shaft hole; and one end of the lamp is connected to the first housing through the lamp rotating shaft.

The present disclosure has the following advantages:

(1) The spot lamp holder includes two components, the first housing and the second housing, and the number of components is relatively small. Compared with the existing spot lamp holder containing three or more components, the spot lamp holder of the present disclosure is convenient and quick to assemble.

(2) The first housing and the second housing are assembled by clamping the mounting groove and the clamping portion. Compared with the assembling of various components of an existing spot lamp holder by tightening screws, the first housing and the second housing of the present disclosure can be assembled conveniently and rapidly.

The above is only the best embodiment of the present disclosure, and does not limit the present disclosure in any form. Any person skilled in the art can make many possible changes and modifications to the technical solutions of the present disclosure by using the above disclosed methods and contents without departing from the scope of the technical solution of the present disclosure, which belongs to the protection scope of the accompanying claims.

What is claimed is:

1. A spot lamp holder, comprising:

a first housing, and a second housing comprising a mounting cavity, wherein a mounting end of the second housing is an open end and coupled with the mounting cavity; wherein a first limiting portion and a second limiting portion spaced apart from each other are disposed on an inner wall of the mounting cavity; wherein a mounting groove is disposed between the first limiting portion and the second limiting portion; and wherein the first housing comprises a clamping portion, the clamping portion is fitted with the mounting groove; and wherein the first limiting portion and the second limiting portion are in a ring shape, and an inner diameter of the second limiting portion is smaller than an inner diameter of the first limiting portion.

2. The spot lamp holder according to claim 1, wherein a distance between the second limiting portion and the mounting end of the second housing is greater than a distance between the first limiting portion and the mounting end of the second housing; wherein the clamping portion comprises a movable body, the movable body is fitted with the first limiting portion.

3. The spot lamp holder according to claim 2, wherein the movable body is made of an elastic material.

4. The spot lamp holder according to claim 2, wherein the movable body comprises a main portion; wherein a convex ring is disposed between the first limiting portion and the second limiting portion on the inner wall of the mounting cavity; and wherein a clamping groove is disposed between the convex ring and the first limiting portion and matched with the main portion.

5. The spot lamp holder according to claim 2, wherein the first housing comprises an inwardly depressed anti-collision groove disposed corresponding to the movable body.

6. The spot lamp holder according to claim 5, further comprising an operating portion coupled to the movable body, and the operating portion is disposed directly facing the anti-collision groove.

7. The spot lamp holder according to claim 2, wherein an outer lateral surface of the movable body comprises an inclined guide surface; wherein the inclined guide surface comprises a proximal end that is close to the first limiting portion and a distal end that is far away from the first limiting portion; and wherein the inclined guide surface is slanted from the distal end to the proximal end toward the inner wall of the mounting cavity.

8. The spot lamp holder according to claim 2, wherein the clamping portion comprises a movable body and a second ring; and wherein the movable body is mounted on the second ring.

9. The spot lamp holder according to claim 8, wherein the first housing comprises a first connecting portion; wherein the first connecting portion comprises a clamping portion and a first ring; wherein a distance between the first ring and a connecting end of the first connecting portion is greater than a distance between the second ring and the connecting end of the first connecting portion; and wherein the first ring comprises an inwardly depressed anti-collision groove disposed corresponding to the movable body.

10. The spot lamp holder according to claim 1, wherein the second housing comprises a limiting block, the first housing comprises a stop block, and the stop block is fitted with the limiting block in a direction of rotation of the first housing.

11. The spot lamp holder according to claim 10, wherein the limiting block is disposed on the inner wall of the mounting cavity, and the stop block is disposed on the clamping portion.

12. The spot lamp holder according to claim 11, wherein the stop block comprises a shaft hole.

13. The spot lamp holder according to any one of claim 1, wherein the first housing comprises an arc-shaped mounting block; and wherein a sliding groove is disposed on the arc-shaped mounting block.

14. A spot lamp, comprising:

a first housing, and a second housing comprising a mounting cavity, wherein a mounting end of the second housing is an open end and coupled with the mounting cavity; wherein a first limiting portion and a second limiting portion spaced apart from each other are disposed on an inner wall of the mounting cavity; wherein a mounting groove is disposed between the first limiting portion and the second limiting portion; wherein the first housing comprises a clamping portion, the clamping portion is fitted with the mounting groove; wherein a lamp assembly is mounted on the spot lamp holder; and wherein the lamp assembly comprises a lamp; and wherein the first limiting portion and the second limiting portion are in a ring shape, and an inner diameter of the second limiting portion is smaller than an inner diameter of the first limiting portion.

15. The spot lamp according to claim 14, wherein the first housing is provided with a sliding groove in which a sliding screw is disposed; and wherein the sliding screw is fitted with the sliding groove, and the sliding screw is coupled to the lamp assembly.

16. The spot lamp according to claim 15, wherein the second housing comprises a limiting block, the first housing comprises a stop block; wherein the stop block is fitted with the limiting block in a direction of rotation of the first housing; wherein the stop block has a shaft hole; a lamp rotating shaft is mounted in the shaft hole; and wherein one end of the lamp is coupled to the first housing through the lamp rotating shaft.

* * * * *